United States Patent [19]

Linzie et al.

[11] Patent Number: 4,717,392

[45] Date of Patent: Jan. 5, 1988

[54] METHOD OF PRODUCING AN IGNESCENT MATERIAL

[76] Inventors: Sören Linzie; Inger Linzie, both of S:a Bryggerivägen 40, S-663 02 Hammarö, Sweden

[21] Appl. No.: 885,593

[22] PCT Filed: Nov. 20, 1984

[86] PCT No.: PCT/SE84/00398

§ 371 Date: Jul. 14, 1986

§ 102(e) Date: Jul. 14, 1986

[87] PCT Pub. No.: WO86/03219

PCT Pub. Date: Jun. 5, 1986

[51] Int. Cl.[4] ..... C10L 11/06

[52] U.S. Cl. ..... 44/41; 44/38

[58] Field of Search ..... 44/41, 38

[56] References Cited

U.S. PATENT DOCUMENTS

| | | | |
|---|---|---|---|
| 2,007,694 | 7/1935 | Rutherford | 44/41 |
| 2,094,661 | 10/1937 | Macleay et al. | 44/41 |
| 3,395,003 | 7/1968 | Alexander | 44/41 |
| 4,518,394 | 5/1985 | Templin et al. | 44/41 |

FOREIGN PATENT DOCUMENTS

| | | | |
|---|---|---|---|
| 2007483 | 1/1970 | France | 44/41 |
| 363729 | 12/1931 | United Kingdom | 44/41 |

*Primary Examiner*—Carl F. Dees

*Attorney, Agent, or Firm*—Murray and Whisenhunt

[57] ABSTRACT

The manufacturing of an ignescent material comprises feeding cellulose pulp in the form of a web (6) through a bath (2) of molten, combustible, organic impregnating substance, said substance being solid at room temperature, thereby soaking said pulp with said substance. According to the invention, more than 50% of the pulp is chemically modified thermomechanical pulp, so called CTMP. The impregnating substance is preferably paraffin.

10 Claims, 2 Drawing Figures

METHOD OF PRODUCING AN IGNESCENT MATERIAL

TECHNICAL SCOPE

The present invention relates to a method of producing an ignescent material, said method comprising the feeding of cellulose pulp in the form of an elongate web through a bath of molten, combustible, organic impregnating substance, said substance at room temperature being solid, thereby soaking said pulp with said substance.

BACKGROUND ART

For the ignition of briquets and charcoal for grills up till now ignescent fluid has been the dominating and sole accepted ignition aid for producing in an acceptably short time embers for broiling. Among the drawbacks of ignescent fluid are the hazards of the ignition procedure. At times, ignescent fluid has been confused with other fluids and caused severe burns in children and in some known instances children have been poisoned by drinking the fluid. In addition, the ignescent fluid is bulky and generally difficult to bring along. It sometimes also imparts obtrusive flavours to the food being broiled. The use of ignescent fluid is also expensive.

To light a fire in fireplaces, furnaces, and suchlike, one normally uses newspaper leaves and the like, in conjunction with wood chips. This is a time-consuming method. Ignition aids known as 'fire lighters' may also be used. A method for producing fire lighting aids was described in SE-A-No. 41 897, in 1914. According to this method, paper, sulphite or sulphate pulp, is impregnated with a combustible substance which is either liquid or solid, such as resin, resin dissolved in some combustible substance such as spirits, turpentine, raw or refined petroleum, tar, or some other suitable substance. After being impregnated, the paper or the pulp is rolled onto spindles, and fire lighting aids then prepared from the strips, whether wet or dry, the final product being in the form of small reels. According to SE-A-No. 96 174 fire lighters are produced from lumbering or wood mill debris, which is cut into chips, defibrated, mixed with water to achieve a suitable consistency and lastly formed into a plate, which is dewatered by pressing and then dried. This plate is dipped in molten paraffin, stearin, or tallow or a mixture of these at a temperature of 80°–100° C. After drying, the plate is cut into pieces of a certain width and length. Before being impregnated, the plate is provided with grooves, to facilitate the cutting of the plate into small square blocks.

A drawback which is common to these and other known fire lighting aids is that the area of combustion is small, the product thus having to be ignited at a very small area. Therefore, it is not at all uncommon to fail at the ignition of these products, even if the burning time may be long. In addition, the positioning of the lighter is critical, for instance when lighting a fire on a grill, since the lighter, being very small, may easily fall down through the grid.

Another known lighting aid consists of cubes of a brittle material which easily crumbles and has a strong odour, so that the product must be carefully packed and gently handled.

Paraffin impregnated cellulose pulp is a better lighting aid. The area of combustion of this product in relation to its volume is greater, and hence the product burns more intensely and over a larger area. Even though its burning time is shorter than that of a more compact product of the same volume, the fire or the bed of briquettes or coal to be ignited is lit more effectively and more safely. Another desirable property of the lighter is that it is free of tackiness. Nor should it crumble when broken, as is the case if not all paraffin has become absorbed into the pulp. At the same time it must be water-repellent and inflammable. These demands have caused considerable manufacturing problems.

DISCLOSURE OF INVENTION

The object of the invention is to solve the manufacturing problems mentioned. Particularly, an object of the invention is to provide a method of producing lighting aids by impregnating cellulose pulp with a combustible substance so that a non-tacky, sheet-formed product results. This object may be realized by letting more than 50%, preferably more than 75%, of the cellulose pulp be chemically modified thermo-mechanical pulp, CTMP. The rest of the material may be, eg sulphate pulp. The impregnating substance is preferably paraffin with a melting point of between 50° and 60° C., the impregnating melt then being held at above 90° C., preferably above 100° C., although not above 130° C., preferably not above 115° C. At these temperatures, impregnation is quick and excess impregnating substance is drained off in a short time, so that no excess substance stays on the surface, there to solidify. At higher temperatures, the pulp softens too much, in other words it looses its mechanical strength to such a degree that it may not be fed continuously through the melt without risk. In other words, the web may break. Under the conditions stated, the pulp, being fed continuously through the melt, need not be submerged in the melt for more than 5 to 20 seconds. Preferably, it should not be submerged for more than 15 seconds.

When the cellulosic material is fully saturated with the impregnating substance, as evidenced by the cessation of bubbles escaping from the pulp, the excess substance is allowed to drain, and then the impregnated material is cooled while flat until the temperature reaches 20° to 40° C., preferably to a temperature between 25° and 35° C. At this temperature, the paraffin solidifies quickly in the pulp. A lower or a higher temperature leads to difficulties when the product is cut into flat sheets, which are then piled and strapped. At lower temperatures, the strapping paper or the label does not stick to the product, and furthermore, the sheets tend to bend. At higher temperatures, problems arise in connection with the cutting into sheets, the material tending to be sticky and the edges fringing.

Further characteristics, aspects, and advantages of the invention will become apparent from the appended patent claims and the following description of experiments done and of a preferred embodiment.

BRIEF DESCRIPTION OF DRAWINGS

In the following description of the manufacturing method and of experiments carried out, reference will be made to the attached drawings wherein FIG. 1 schematically illustrates the manufacturing process and the equipment used therein.

DESCRIPTION OF MANUFACTURING TECHNIQUE AND EXPERIMENTS DONE

Figure 1:
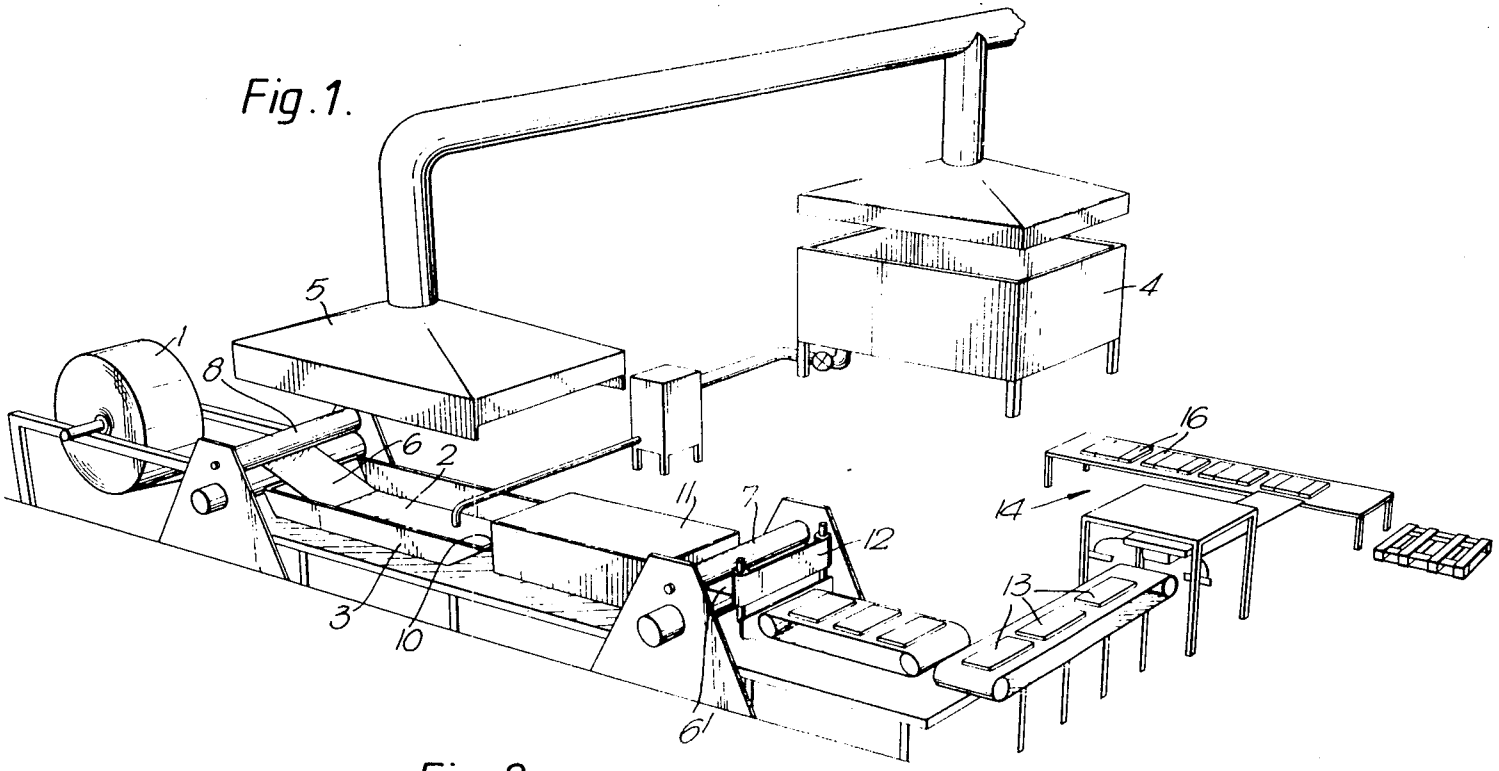

The technique applied and the equipment utilized in the manufacturing process are illustrated in FIG. 1. The starting materials are a roll 1 of cellulose pulp and molten paraffin 2 in a trough 3. The melt is produced in a melting-pot 4. An exhaust hood is designated 5. The paraffin is of foodstuff quality. Its melting point is between 52° and 58° C., it is essentially free of aromatic substances, and has an oil content of less than 1%, preferably less than 0.5%. The pulp is reeled off the roll 1 continuously and the web 6 is fed through the melt 2 by means of two pairs 7, 8 of feeding rollers. The web 6 is dragged along the bottom of the trough 3 at a speed which allows the soaking of the web material 6 to be completed just before the web is pulled out of the melt 2. The infiltration of molten paraffin into the pulp is indicated by small bubbles rising to the surface of the melt, while the web 6 passes through it. The cessation of this formation of bubbles is evidence that the pulp is saturated with paraffin, and the web feeding speed should be set accordingly.

Figure 2:
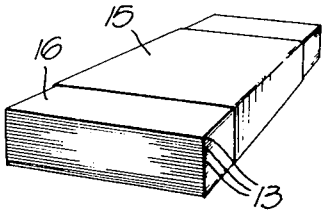
FIG. 2 shows a package with a number of sheets of the lighting aid according to the invention.

The web material 6 thus having become saturated with paraffin in the melt 2, excess paraffin is allowed to drain as the web passes through a short draining zone 10, before entering a cooling chamber 11, in which it is cooled by air until it reaches a temperature slightly above ambient. In the cooling chamber 11, the soaked web is dragged along the bottom of the cooling trough by means of the feeding rolles 7, so that the web is extended and becomes flat before the paraffin solidifies in the pulp. As the web leaves the chamber 11 the temperature has been lowered to between 25° and 35° C. The next step in the production process is to cut the stiff web material 6' into pieces 10 cm long, in a cutter 12. Finally the finished lighting aids 13, in the form of sheets, 2 mm thick and 10×20 cm wide and long, are fed to a piling and strapping machine 14, which straps a gummed label 15 around them, see FIG. 2. The pile of sheets has been designated 16.

EXPERIMENTS

For the following experiments foodstuff quality paraffin was used. The different examples serve to show the importance of the choice of cellulosic material.

EXAMPLE 1

In this case sulphite pulp was used. Several problems were noted. The lighting aid obtained was of a highly varying quality, because the paraffin did not penetrate the material evenly. Nor did the paraffin drain easily in the draining zone. The surface did not become dry and fibrous, as desired. Instead, it became fatty, slippery, and smeary, and paraffin which had solidified on the surface crumbled. In addition, the web had to be forwarded slowly through the melt, so as to achieve at least some degree of saturation.

EXAMPLE 2

In this case the web material was board as used for egg cartons. The result was as negative as for the sulphite pulp of example 1. The impregnation required a dwell time of 60 seconds for a melt temperature of 100° C.

EXAMPLE 3

The following saturation times were noted with purely mechanical pulp.

| Temperature, °C. | Soaking time required, seconds |
|---|---|
| 89 | 35 |
| 95 | 50 |
| 100 | 35 |
| 105 | 60 |

The variation in the time required for full impregnation illustrates the difficulty of reproducibly manufacturing a product of prime quality. In this case also, the product surface became smeary.

EXAMPLE 4

In these experiments pulped broke of different qualities intended for the production of beer glass pads was used. The grammage of the material varied from 540 to 775 g/m$^2$ and the thickness varied from 1.4 to 2.2 mm. Impregnation was slow for all the tested qualities. Some of the products were very smeary, whereas others were much less so. None was acceptable in this respect, however. The longest burning time was obtained with "unbleached beer glass pad board", 2.2 mm thick and with a grammage of 775 g/m$^2$: 4.5 minutes. Impregnation was poor with unbleached, sized "beer glass pad board", and hence the burning time was shorter, 3.5 minutes, although the grammage was the same.

EXAMPLE 5

In this example, which is according to the invention, the pulp consisted of a mixture of so called CTMP, ie thermomechanical pulp, chemically modified by a solution of sodium sulphite/bisulphite, and sulphate pulp. The raw material for the pulp was pine tree wood chips, a mixture of Nordic fir (Picea albis) and pine (Pinus silvestris). The grammage was 625 g/m$^2$ and the thickness 2.3 mm. The soaking with paraffin was completed in but 8 seconds at a temperature of 105° C. Excess paraffin drained quickly in the draining zone. The finished lighting aid was completely dry on the surface, i e it did not smear, and had a fibrous texture to the touch, as is desirable. It was easily packed and labeled. The burning time was appr 6.5 minutes.

We claim:

1. A method of producing an ignescent material, said method comprising feeding cellulose pulp in the form of an elongate web having a thickness of between 1 and 4 mm and a grammage of between 550 and 700 g/m$^2$ through a bath of molten, combustible, organic impregnating substance consisting essentially of paraffin having a melting point of between 50° and 60° C., to thereby impregnate said pulp with said impregnating substance, at least 75% of said pulp being chemically modified thermomechanical pulp (CTMP) with the balance being essentially sulphate pulp, said impregnating substance being at an impregnation melt temperature of over 90° C. during impregnation of said web.

2. The method according to claim 1, wherein said web has a thickness of between 1.5 and 3 mm, and a grammage of between 550 and 700 g/m$^2$.

3. The method according to claim 1, wherein said impregnation melt temperature is above 100° C. and not above 130° C.

4. The method according to claim 3, wherein said impregnation melt temperature is above 100° C. and not above 115° C.

5. The method according to claim 3, wherein said impregnating substance is paraffin having a content of oils and aromatics not greater than 1%.

6. The method according to claim 5, wherein said content of oils and aromatics is not greater than 0.5%.

7. The method according to claim 3, wherein said web has a dwell time in said melt of 5 to 20 seconds.

8. The method according to claim 7, wherein said dwell time is not more than 15 seconds.

9. The method according to claim 1, wherein excess impregnating substance is allowed to drain off said web, said web thereafter being cooled at a temperature of between 20° C. and 40° C. while kept flat, said web being finally cut into flat sheets having a thickness essentially the same as that of the web prior to impregnation.

10. The method according to claim 9, wherein said web is cooled at a temperature of between 25° and 35° C.

* * * * *